US008955695B2

(12) United States Patent
Bauer

(10) Patent No.: US 8,955,695 B2
(45) Date of Patent: Feb. 17, 2015

(54) SERPENTINE DISPENSER WITH CARTRIDGES

(71) Applicant: Giraffx Design, LLC, Lake Worth, FL (US)

(72) Inventor: Jamie D. Bauer, Greenacres, FL (US)

(73) Assignee: Giraffx Design, LLC, Lake Worth, FL (US)

( * ) Notice: Subject to any disclaimer, the term of this patent is extended or adjusted under 35 U.S.C. 154(b) by 0 days.

(21) Appl. No.: 14/208,632

(22) Filed: Mar. 13, 2014

(65) Prior Publication Data

US 2014/0190912 A1 Jul. 10, 2014

Related U.S. Application Data

(60) Provisional application No. 61/783,784, filed on Mar. 14, 2013.

(51) Int. Cl.
*A47F 1/04* (2006.01)
*A47F 7/00* (2006.01)
*A47F 1/08* (2006.01)

(52) U.S. Cl.
CPC .. *A47F 1/04* (2013.01); *A47F 1/087* (2013.01)
USPC ..... 211/59.2

(58) Field of Classification Search
CPC ..... A47F 1/126
USPC ..... 211/59.2; 312/42, 45; 221/282, 197, 221/194, 198, 17, 31, 175, 176, 185, 285, 221/287, 92, 281
See application file for complete search history.

(56) References Cited

U.S. PATENT DOCUMENTS

| | | | |
|---|---|---|---|
| 902,347 | A | 10/1908 | Tillinghast |
| 1,291,420 | A | 1/1919 | Cough |
| 1,898,056 | A | 2/1933 | Johnson |

(Continued)

FOREIGN PATENT DOCUMENTS

| | | | |
|---|---|---|---|
| EP | 1539607 | B1 | 3/2009 |
| JP | 07-124041 | A | 5/1995 |

(Continued)

OTHER PUBLICATIONS

International Search Report and Written Opinion for International Application No. PCT/US2014/027165. Issued on May 26, 2014.

*Primary Examiner* — Joshua Rodden
*Assistant Examiner* — Kimberley S Wright
(74) *Attorney, Agent, or Firm* — Brown & Michaels, PC

(57) ABSTRACT

A serpentine dispenser for dispensing stacks of nested cans from a cartridge allows cans to be dispensed without slip sheets between individual cans, or internal dispenser walls separating can facings. Jam-free dispenser feeding is achieved by constructing a cartridge holding area wider than the dispenser down chute, such that the cartridge may be easily inserted and removed from the dispenser, but cans exiting the cartridge are maintained in a nested stack by the narrower width of the down chute. A lower feed channel that is narrower than the cartridge holding area maintains cans in a nested stack as they are delivered to a product selection area. The product selection area is wider than the lower feed channel so that individual cans may un-nest and be individually selected. In some embodiments, the product selection area is extended to allow two stacks of nested cans to separate, forming a self-facing dispenser.

17 Claims, 9 Drawing Sheets

(56) References Cited

U.S. PATENT DOCUMENTS

| | | | | | |
|---|---|---|---|---|---|
| 2,382,191 | A | * | 8/1945 | Weichselbaum | 312/45 |
| 2,511,099 | A | * | 6/1950 | Case | 221/123 |
| 2,996,344 | A | | 8/1961 | Garman | |
| 3,026,002 | A | * | 3/1962 | Torres | 221/67 |
| 3,055,293 | A | | 9/1962 | Lariccia | |
| 3,178,242 | A | | 4/1965 | Ellis et al. | |
| 3,203,554 | A | | 8/1965 | Pendergrast, Jr. et al. | |
| 3,300,115 | A | | 1/1967 | Schauer | |
| 3,361,506 | A | * | 1/1968 | Newberry | 312/45 |
| 3,662,898 | A | * | 5/1972 | Baxendale | 211/59.2 |
| 3,757,998 | A | * | 9/1973 | Millies et al. | 221/242 |
| 3,784,022 | A | * | 1/1974 | Beesley, Jr. | 211/59.2 |
| 3,858,757 | A | * | 1/1975 | Langdon, Jr. | 221/92 |
| 3,923,159 | A | | 12/1975 | Taylor et al. | |
| 4,228,903 | A | * | 10/1980 | Eckert | 211/59.2 |
| 4,435,026 | A | | 3/1984 | Johnson | |
| 4,460,107 | A | * | 7/1984 | Lindsey | 221/67 |
| 4,598,828 | A | | 7/1986 | Young et al. | |
| 4,685,590 | A | * | 8/1987 | Negishi et al. | 221/241 |
| 4,823,982 | A | | 4/1989 | Aten et al. | |
| 4,915,571 | A | | 4/1990 | Toshihiko et al. | |
| 5,289,943 | A | | 3/1994 | Powell | |
| 5,314,078 | A | | 5/1994 | Morikiyo et al. | |
| 5,328,258 | A | | 7/1994 | Scalise | |
| 5,390,821 | A | | 2/1995 | Markel | |
| D363,174 | S | | 10/1995 | Fletcher | |
| 5,462,198 | A | | 10/1995 | Schwimmer | |
| 5,529,207 | A | * | 6/1996 | Oden et al. | 221/67 |
| 5,540,315 | A | * | 7/1996 | Haiki et al. | 193/27 |
| 5,788,117 | A | | 8/1998 | Zimmanck | |
| 5,836,478 | A | | 11/1998 | Weiss | |
| 5,848,724 | A | * | 12/1998 | Uzzle et al. | 221/67 |
| 5,878,862 | A | | 3/1999 | Dewsnap | |
| 5,894,942 | A | | 4/1999 | Miyashita et al. | |
| 6,206,237 | B1 | * | 3/2001 | Dillon et al. | 221/289 |
| 6,253,930 | B1 | | 7/2001 | Freidus et al. | |
| 6,302,293 | B1 | * | 10/2001 | Wittern et al. | 221/92 |
| 6,427,866 | B1 | * | 8/2002 | Hawker et al. | 221/132 |
| 6,431,398 | B1 | * | 8/2002 | Cook et al. | 221/124 |
| 6,513,887 | B2 | * | 2/2003 | Paczkowski et al. | 312/45 |
| 6,523,725 | B1 | * | 2/2003 | Paczkowski et al. | 222/241 |
| 6,991,116 | B2 | | 1/2006 | Johnson et al. | |
| 7,032,776 | B2 | * | 4/2006 | Hieb | 221/231 |
| 7,207,447 | B2 | * | 4/2007 | Medcalf et al. | 211/59.2 |
| 7,552,857 | B2 | | 6/2009 | Harrelson | |
| 7,717,321 | B2 | * | 5/2010 | Spivey et al. | 229/122.1 |
| 7,922,437 | B1 | * | 4/2011 | Loftin et al. | 414/412 |
| 7,992,747 | B2 | | 8/2011 | Bauer | |
| 8,047,400 | B1 | | 11/2011 | Lumberto | |
| 8,127,980 | B2 | * | 3/2012 | Spivey et al. | 229/120.32 |
| 8,162,206 | B2 | | 4/2012 | Harrelson | |
| 8,302,809 | B1 | | 11/2012 | Bogdziewicz, III et al. | |
| 8,308,023 | B2 | | 11/2012 | Gelardi et al. | |
| 8,322,543 | B2 | | 12/2012 | Gelardi et al. | |
| 8,448,815 | B2 | | 5/2013 | Sholl et al. | |
| 8,550,261 | B2 | | 10/2013 | Loftin et al. | |
| 8,628,003 | B2 | * | 1/2014 | Thomas et al. | 229/242 |
| 2004/0011751 | A1 | * | 1/2004 | Johnson et al. | 211/59.2 |
| 2004/0200789 | A1 | * | 10/2004 | Woodbury | 211/59.2 |
| 2005/0127015 | A1 | * | 6/2005 | Medcalf et al. | 211/59.2 |
| 2006/0180488 | A1 | * | 8/2006 | Spivey et al. | 206/427 |
| 2007/0007221 | A1 | | 1/2007 | Mann | |
| 2009/0090739 | A1 | * | 4/2009 | Merl | 221/289 |
| 2009/0212066 | A1 | * | 8/2009 | Bauer | 221/281 |
| 2009/0308885 | A1 | * | 12/2009 | Sainato et al. | 221/194 |
| 2010/0072150 | A1 | | 3/2010 | Takashima et al. | |
| 2010/0096401 | A1 | * | 4/2010 | Sainato et al. | 221/8 |
| 2010/0187295 | A1 | * | 7/2010 | Spivey et al. | 229/120.38 |
| 2010/0252619 | A1 | | 10/2010 | Harrelson | |
| 2010/0295424 | A1 | * | 11/2010 | Alexander | 312/109 |
| 2011/0121010 | A1 | * | 5/2011 | Loftin et al. | 221/1 |
| 2011/0121011 | A1 | * | 5/2011 | Gelardi et al. | 221/30 |
| 2012/0018391 | A1 | * | 1/2012 | Gelardi et al. | 211/59.2 |
| 2012/0074160 | A1 | | 3/2012 | Thomas et al. | |
| 2012/0074164 | A1 | | 3/2012 | Walling et al. | |
| 2012/0080513 | A1 | * | 4/2012 | Thomas et al. | 229/200 |
| 2012/0097694 | A1 | * | 4/2012 | Gelardi | 221/1 |
| 2012/0104082 | A1 | * | 5/2012 | Spivey et al. | 229/122 |
| 2012/0152970 | A1 | * | 6/2012 | Thomas | 221/1 |
| 2012/0211510 | A1 | | 8/2012 | Gelardi et al. | |
| 2012/0211522 | A1 | | 8/2012 | Gelardi et al. | |
| 2012/0217213 | A1 | | 8/2012 | Thomas | |
| 2012/0217261 | A1 | | 8/2012 | Bailey et al. | |
| 2012/0223090 | A1 | | 9/2012 | Thomas et al. | |
| 2012/0228247 | A1 | | 9/2012 | Loftin et al. | |
| 2012/0279893 | A1 | | 11/2012 | Gelardi et al. | |
| 2012/0285976 | A1 | * | 11/2012 | Bogdziewicz et al. | 221/1 |
| 2012/0285977 | A1 | | 11/2012 | Bates et al. | |
| 2012/0318817 | A1 | | 12/2012 | Zacherle et al. | |
| 2012/0325839 | A1 | | 12/2012 | Bates et al. | |
| 2013/0020341 | A1 | | 1/2013 | Bogdziewicz, III et al. | |
| 2013/0062360 | A1 | | 3/2013 | Bogdziewicz, III et al. | |
| 2013/0062361 | A1 | | 3/2013 | Loflin et al. | |
| 2013/0105509 | A1 | * | 5/2013 | Gelardi et al. | 221/194 |
| 2013/0134119 | A1 | * | 5/2013 | Loftin et al. | 211/59.2 |
| 2013/0134177 | A1 | | 5/2013 | Loftin | |
| 2013/0221017 | A1 | | 8/2013 | Zacherle et al. | |
| 2013/0221020 | A1 | | 8/2013 | Zacherle et al. | |
| 2013/0233813 | A1 | | 9/2013 | Zacherle et al. | |
| 2013/0248468 | A1 | | 9/2013 | Burton et al. | |
| 2013/0270203 | A1 | | 10/2013 | Burton et al. | |
| 2013/0277321 | A1 | | 10/2013 | Zacherle | |
| 2013/0277385 | A1 | | 10/2013 | Zacherle | |
| 2014/0001200 | A1 | | 1/2014 | Bates et al. | |
| 2014/0054310 | A1 | | 2/2014 | Loftin et al. | |
| 2014/0061217 | A1 | | 3/2014 | Fortuna et al. | |
| 2014/0076922 | A1 | | 3/2014 | Binshtok et al. | |
| 2014/0102942 | A1 | | 4/2014 | Thomas et al. | |
| 2014/0103056 | A1 | | 4/2014 | Thomas et al. | |
| 2014/0291348 | A1 | * | 10/2014 | Liu et al. | 221/251 |

FOREIGN PATENT DOCUMENTS

| | | | | |
|---|---|---|---|---|
| JP | 11-346880 | A | | 12/1999 |
| JP | 2008-080058 | A | | 4/2008 |
| JP | 2013-537443 | A | | 10/2013 |
| JP | 2013-540663 | A | | 11/2013 |
| WO | 2012-012201 | A1 | | 1/2012 |
| WO | 2012-012677 | A1 | | 1/2012 |
| WO | WO2012/012677 | | * | 1/2012 |
| WO | 2012-040053 | A1 | | 3/2012 |
| WO | 2012-044461 | A1 | | 4/2012 |
| WO | 2012-082233 | A1 | | 6/2012 |
| WO | 2012-115727 | A1 | | 8/2012 |
| WO | 2012-115728 | A1 | | 8/2012 |
| WO | 2012-118776 | A1 | | 9/2012 |
| WO | 2013-036439 | A1 | | 3/2013 |
| WO | 2013-036443 | A1 | | 3/2013 |
| WO | 2013-078113 | A2 | | 5/2013 |
| WO | 2013-081810 | A1 | | 6/2013 |
| WO | 2013-081814 | A1 | | 6/2013 |
| WO | 2013-126215 | A1 | | 8/2013 |
| WO | 2013-126218 | A1 | | 8/2013 |
| WO | 2013-158434 | A1 | | 10/2013 |
| WO | 2013-162942 | A1 | | 10/2013 |
| WO | 2013-163014 | A1 | | 10/2013 |

* cited by examiner

SERPENTINE DISPENSER WITH CARTRIDGES

REFERENCE TO RELATED APPLICATIONS

This application claims one or more inventions which were disclosed in Provisional Application No. 61/783,784, filed Mar. 14, 2013, entitled "SERPENTINE DISPENSER WITH CARTRIDGES". The benefit under 35 USC §119(e) of the U.S. provisional application is hereby claimed, and the aforementioned application is hereby incorporated herein by reference.

BACKGROUND OF THE INVENTION

1. Field of the Invention

The invention pertains to the field of serpentine product dispensers. More particularly, the invention pertains to serpentine product dispensers for nested and stacked canned goods.

2. Description of Related Art

There are a variety of materials and manufacturing methods used to make cans 1, 2, 3, 4 for canned grocery goods. The serpentine dispenser 500 described herein relates to all cans 1, 2, 3, 4 when categorized into two sub-groups: "non-nesting cans"—those that have hemmed end caps 5 at both top and bottom and cannot nest within each other when stacked, as shown in prior art FIG. 1A; and "nesting cans" or "stackable cans"—those which have only one hemmed end cap 5 on top and a drawn, nestable stacking design 6 on the bottom as shown in prior art FIG. 1B. Nesting and stackable cans 3, 4 are found in a wide variety of sizes and have different top cap 5 and bottom designs 6 that create different depths ("Dn", FIG. 1B) to which the base of an upper can 4 nests down into the cap of a lower can 3 when stacked and nested. Generally these two designs account for nearly all cans found in grocery stores. While "can" may refer to traditional metal alloy cans or can-like packages molded from various plastics, as used herein the term generally refers to any product package capable of rolling, regardless of material of manufacture, or specific geometry.

U.S. Pat. No. 7,992,747, for example, shows a modular serpentine dispenser for products capable of rolling, such as cans contained in a carton in a single row configuration, or "single facing" as known in the industry. This configuration houses a single row of cans, using one left side wall and one right side wall with various connecting surfaces between the side walls forming a housing, channels, and inclined ramps which hold the carton and direct rolling products exiting the carton to a location where they can be selected by a consumer. The dispenser is also assembled in "multiple facing" configurations, using the above configuration and additional middle walls or dividing ribs separating individual rows, or multiple facings, of products.

Prior art FIGS. 2A and 2B show a multiple facing configuration with two rows of cans. The carton, also referred to as cartridge 220, includes paperboard separator panels, or "slip sheets" 210 as they are commonly known in the industry, between layers of cans 1, 2, 3, 4 to keep them separated during transit. Similar packaging methods are currently in use in the field, especially with bulk packed canned cat food, for example.

FIGS. 2A and 2B show that after insertion into the dispenser 200, slip sheet 210 inside the cartridge 220 aligns both vertically and front to rear with the divider wall 230 in the dispenser 200.

This configuration and alignment causes the cans 1, 2, 3, 4 in each column to roll out of the cartridge 220, drop downward into their respective sides of the dispenser's lower channel 240, and roll forward smoothly to the front dispensing location for selection by a consumer. The uppermost edge 250 of the dividing walls 230 may taper to a knife edge to further facilitate this alignment and smooth feeding from the cartridge 220 to the lower channel 240. These parts, designs, and alignments are necessary to keep the cans 1, 2, 3, 4 from feeding out of the cartridge 220 and onto the top edge 250 of the divider wall 230 and causing a feed jam at that location. Similarly, the middle walls between the facing rows of the dispenser assembly are necessary to keep the cans from entering the lower feed channel and ramp in a random manner and creating a jam in the lower feed channel.

SUMMARY OF THE INVENTION

A serpentine dispenser for dispensing nested stacks of cans from a cartridge allows cans to be dispensed without the need for slip sheets in the cartridge between individual cans, or internal dispenser walls that separate individual can facings for consumer selection. Jam-free feeding of the dispenser is achieved by constructing a cartridge holding area that is wider than the dispenser down chute, such that the cartridge may be easily inserted and removed from the dispenser, but cans exiting the cartridge are maintained in a nested stack by the narrower width of the down chute. Similarly, a lower feed channel that is also narrower than the cartridge holding area maintains cans in a nested stack as they are delivered to a product selection area. The product selection area is wider than the lower feed channel so that the nested stack will un-nest when it reaches the product selection area, such that individual cans can be selected by a consumer. In some embodiments, the length of the product selection area is extended to allow two stacks of cans to separate, and thus form a self-facing dispenser in which cans removed from the front most stack in the dispensing area are automatically replaced by cans behind them in the dispensing area.

DETAILED DESCRIPTION OF THE INVENTION

A serpentine dispenser is constructed to eliminate the need for dispensing channel divider walls and slip sheets in product cartons or cartridges containing multiple facing stacks of nested cans. The dispenser construction also enables jam-free feeding of multiple facing stacks of nested cans, and reliable feeding of the cans to a product selection area where the consumer may easily remove a single can if desired. Both jam-free feeding of multiple facing stacks of nested cans, and easy removal of a single can, (or multiple cans) at the product selection area, is enabled by a variable width dispensing channel connecting the product cartridge and the product selection area.

Figures 1A, 1B:
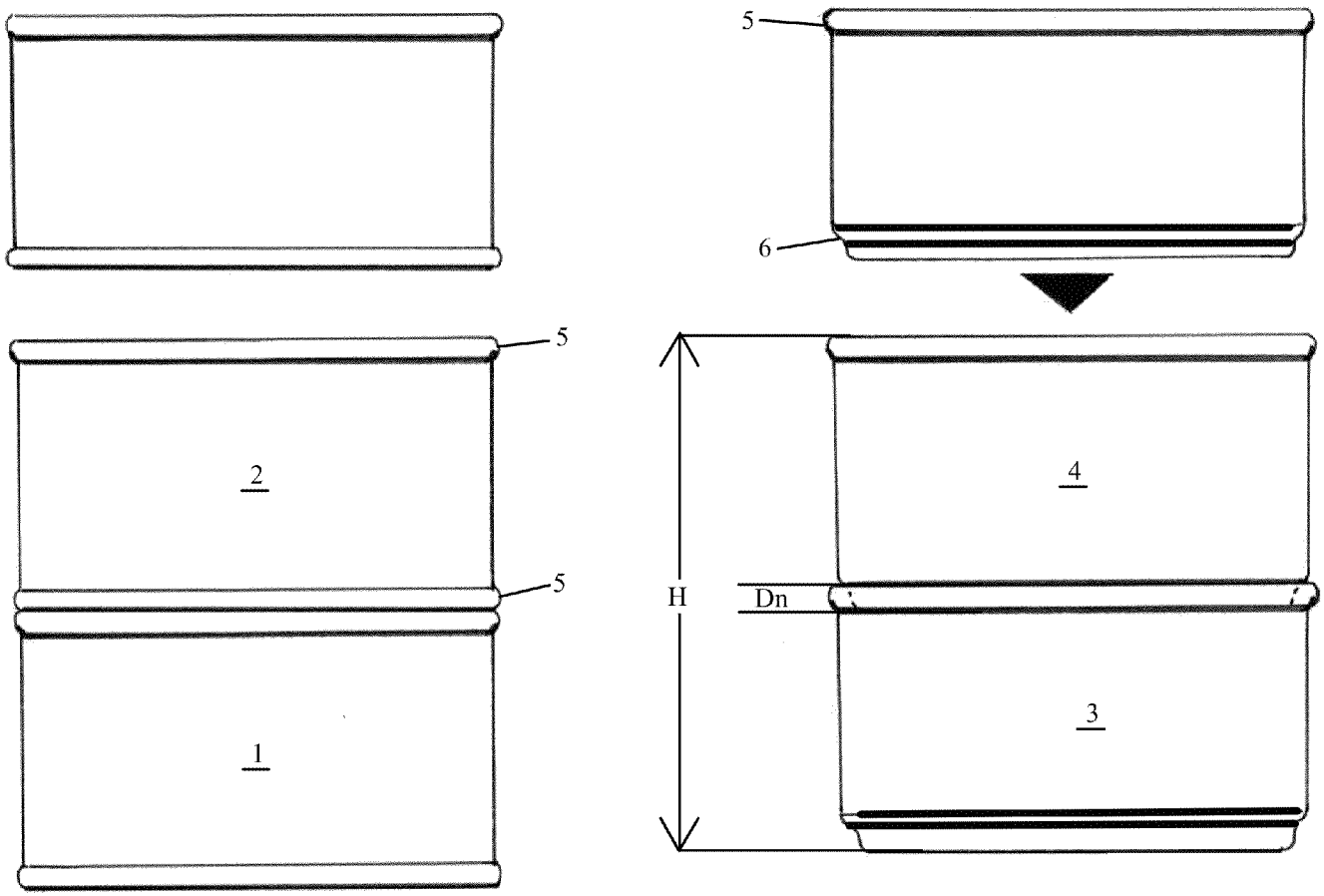
FIG. 1B PRIOR ART
FIG. 1A shows a stack of prior art non-nested cans.
FIG. 1B shows a stack of prior art nested cans.
Figure 2A:
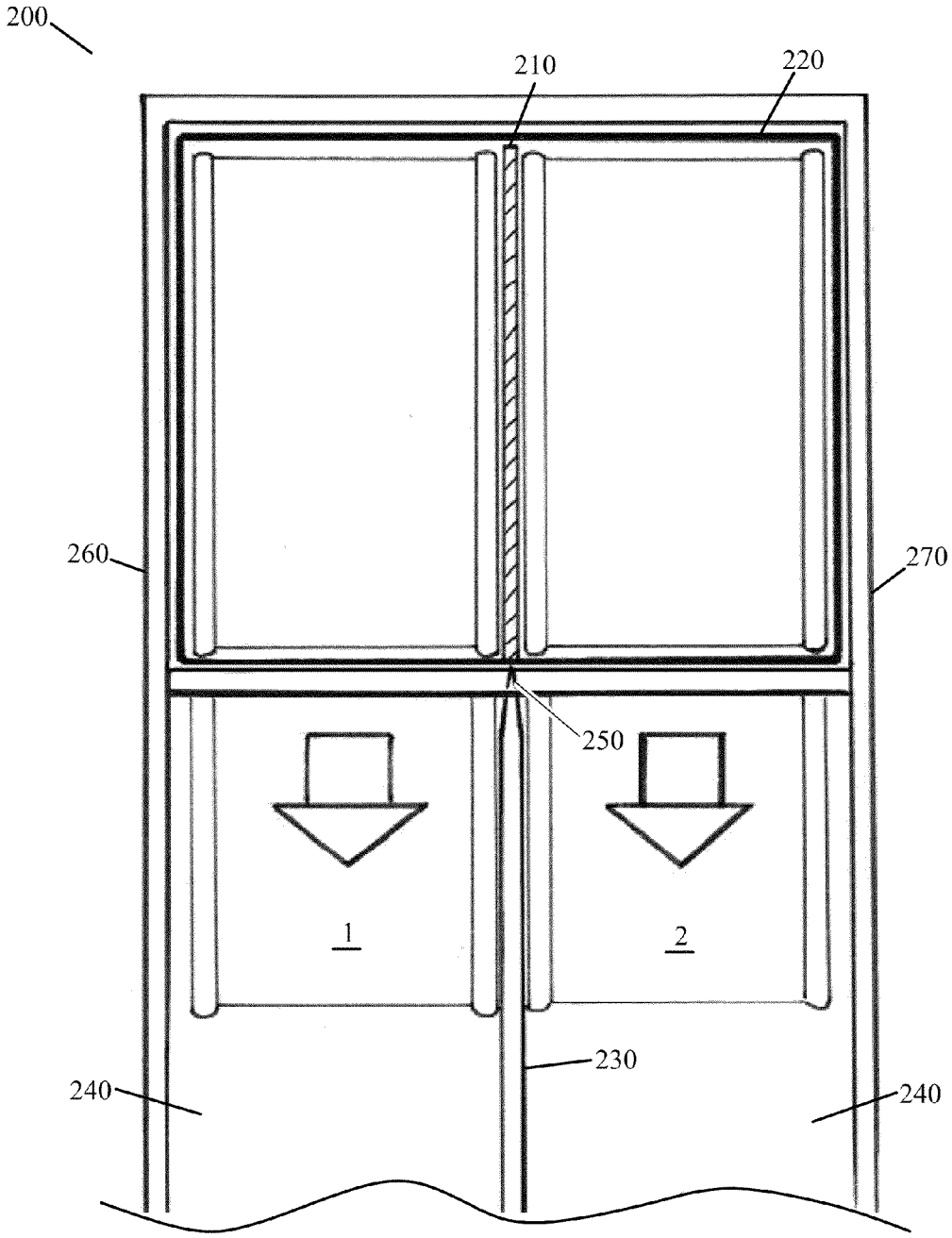
FIG. 2A PRIOR ART
FIG. 2A shows a front view of a prior art cartridge containing two facing non-nested cans and a slip sheet inserted between them in a dispenser having a dividing wall between facings.
Figure 2B:
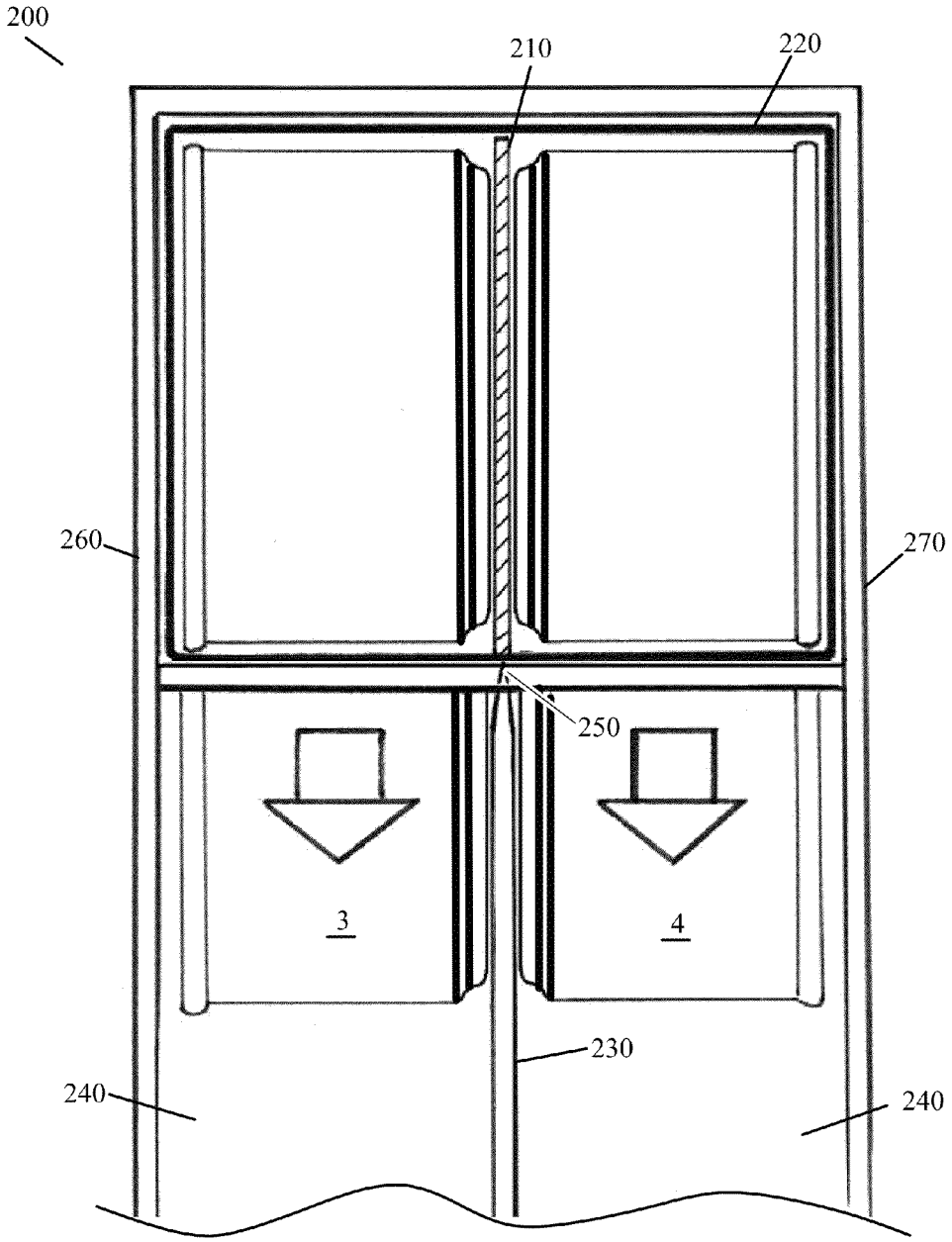
FIG. 2B PRIOR ART
FIG. 2B shows a front view of a prior art cartridge containing two facing nestable cans and a slip sheet inserted between them in a dispenser having a dividing wall between facings.

As shown in prior art FIGS. 1A and 2A, dispenser 200 divider walls 230 and slip sheets 210 have been employed when using cartridges 220 packed with cans 1, 2 that do not nest. When dispensing cans 3, 4 which are capable of nesting, as in prior art FIGS. 1B and 2B, the use of divider walls 230 in the dispensers 200, and slip sheets 210 in the cartridges 220, wastes space and materials within the cartridges 220, dispensers 200, and across store shelves. Eliminating slip sheets 210 and divider walls 230 allows space to be regained for additional product facings across the full width of product categories on the shelves. Eliminating wasted space and packaging elements also creates a significant savings in materials, manufacturing, shipping, and assembly costs.

Figure 3:
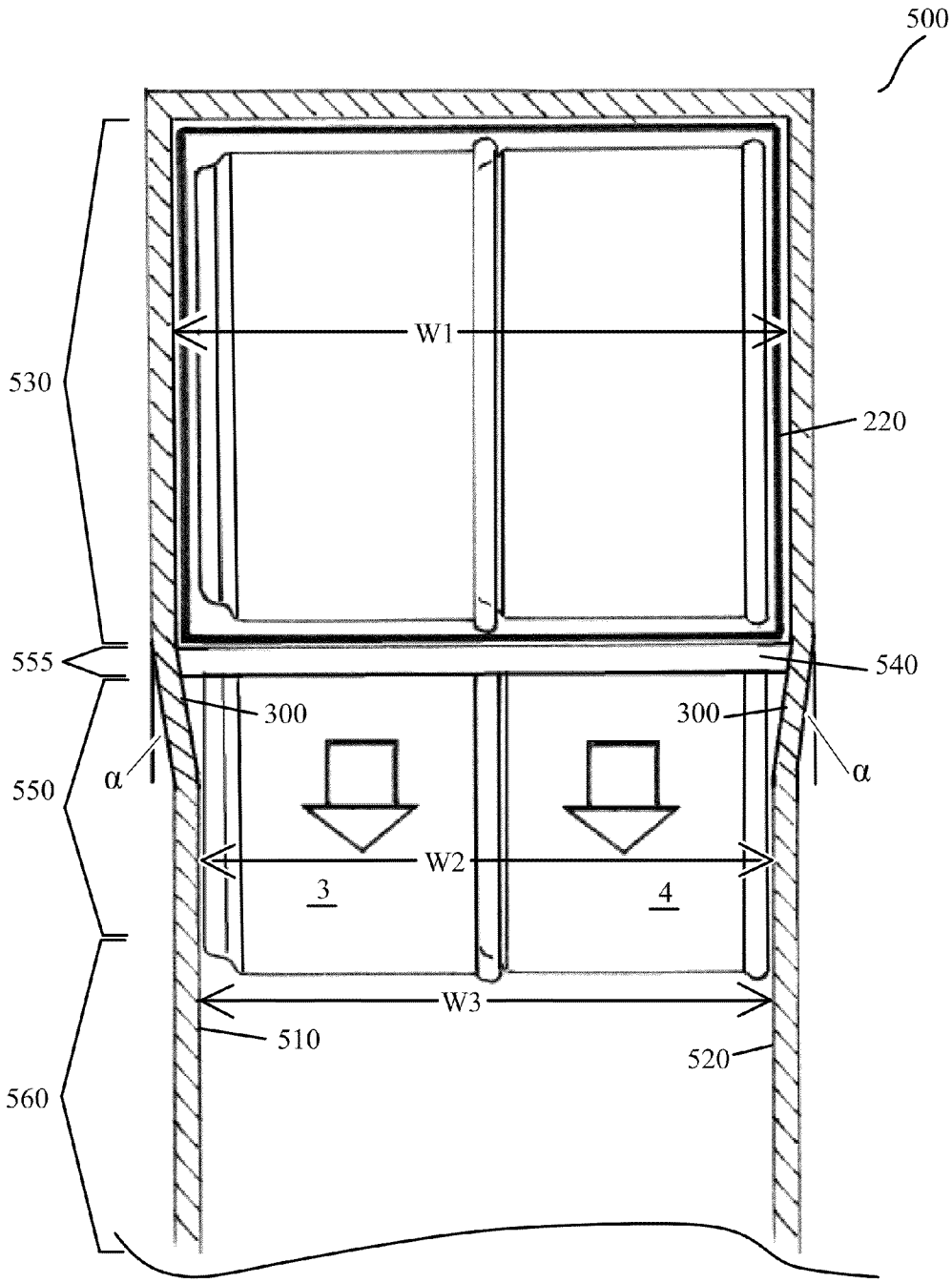
FIG. 3 shows a front section view of a cartridge containing two facing nested cans in a dispenser having a variable width dispensing channel.

As shown in FIG. 3, nestable cans 3, 4 can be shipped inside multiple facing cartons, or cartridges 220, in a nested condition thereby eliminating slip sheets 210 and saving significant amounts of packaging material and packaging costs. The dispensers 500 for these cartridges 220 have no divider walls 230. Instead the various panels between, and connecting, the left side panel 510 and right side panel 520 are as wide as necessary to accommodate the appropriate numbers of product facings and the cartridge 220. The width of the dispenser 500 upper loading channel 530 accommodating the cartridge 220 and tolerances to allow easy insertion and removal of the cartridge is indicated by "W1" in the FIG. 3. FIG. 3 shows a two facing configuration, but cartridges 220 and dispensers 500 may also be constructed to accommodate three or more cans wide (i.e. "three facings" . . . "N facings"). A "four facings" embodiment is shown in FIGS. 5-8.

Figure 4:
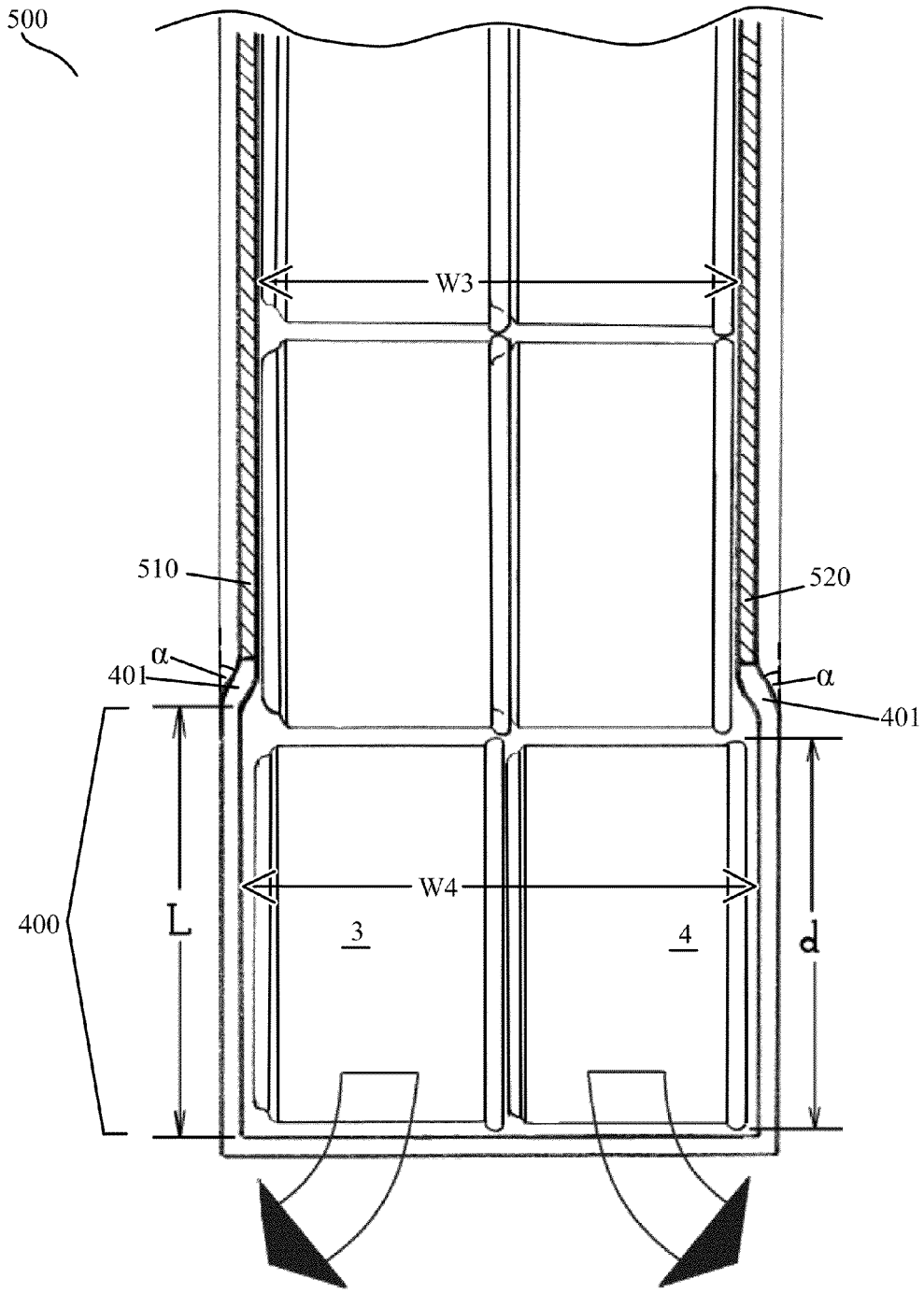
FIG. 4 shows a top view of the dispensing area of a dispenser having a variable width dispensing channel containing two facing nested cans.
Figure 5:
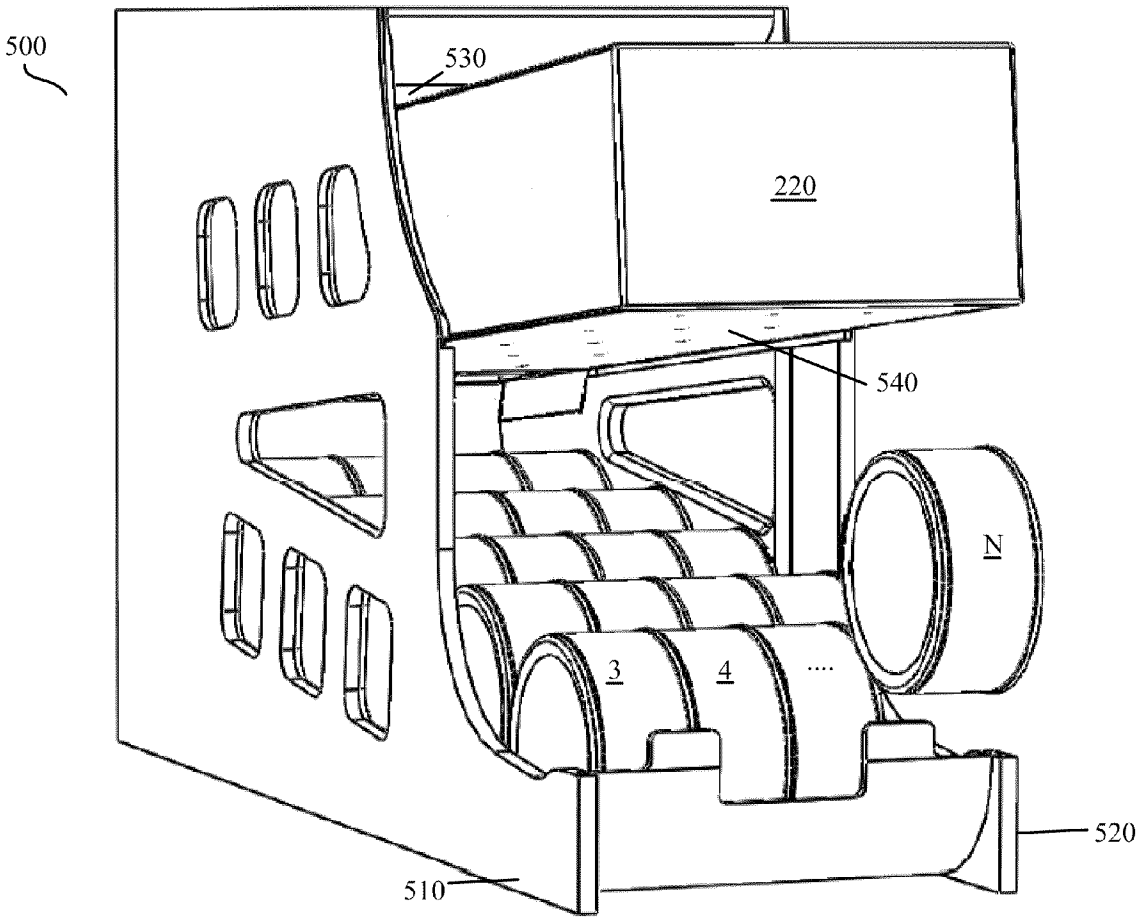
FIG. 5 shows a perspective view of a cartridge containing four facing nested cans in a dispenser having a variable width dispensing channel.

Cans 3, 4 bulk packed for distribution in a nested condition have a feeding problem into, and through, existing dispenser 200 housings which is solved by the arrangement of the dispenser's 500 side walls 510, 520, in the design shown in FIGS. 3-8. FIG. 5 shows a dispenser 500 having a left side wall 510 and right side wall 520 forming an upper channel 530 together with a loading ramp 540 into which a bulk cartridge 220 is inserted. The side walls 510, 520 are sufficiently far apart to accommodate easy insertion of the packed cartridge 220 by store personnel and provide for jam free rolling of the cans inside the cartridge 220. This spacing, "W1" in FIG. 3, will be at least equal to the outer width of the cartridge 220 plus a small additional amount to allow for ease of insertion.

Figure 6:
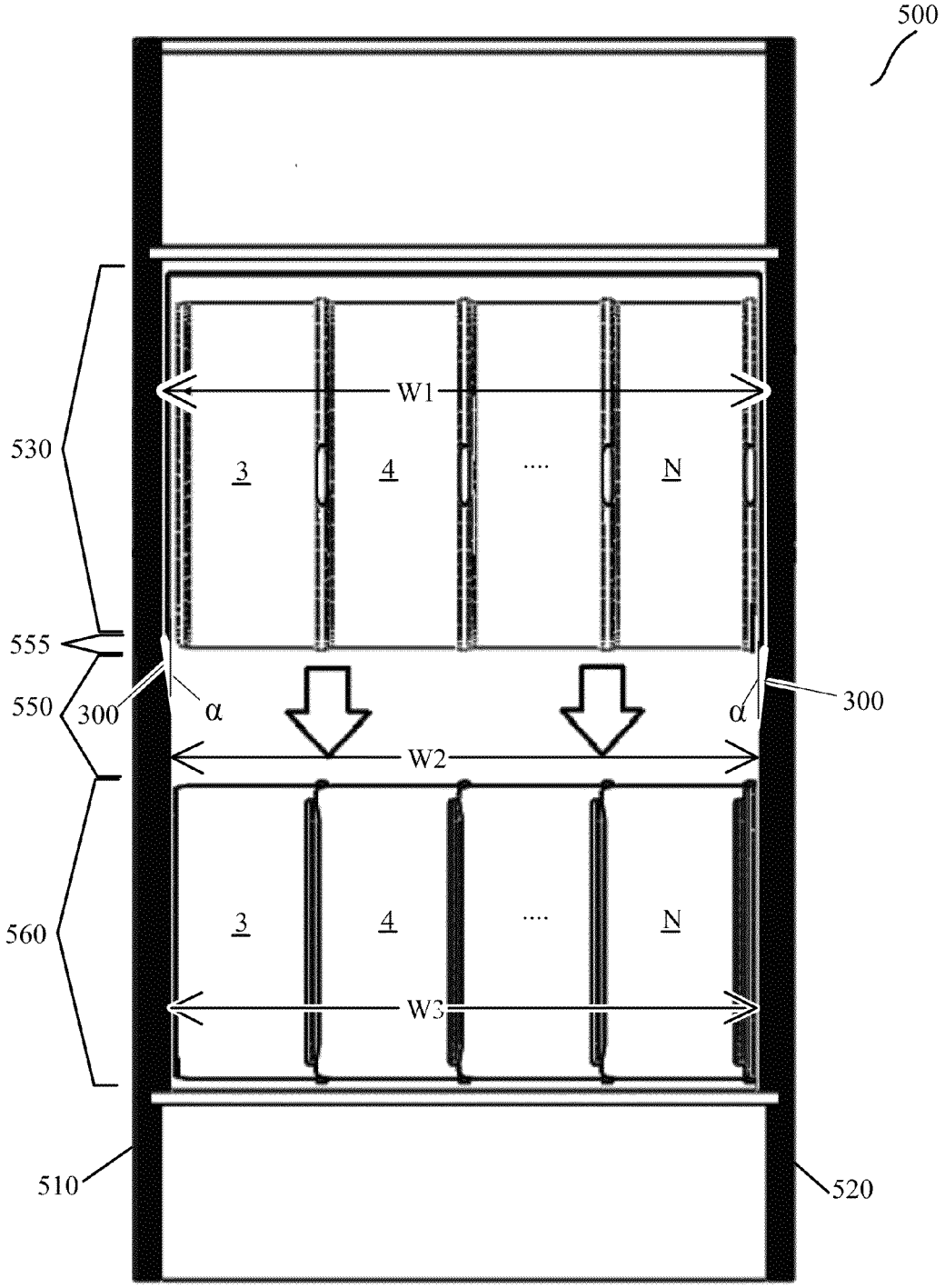
FIG. 6 shows a front section view through the cartridge exit port, cartridge holding area exit port, and down chute of a dispenser having a variable width dispensing channel containing four facing nested cans.

Referring now to FIG. 3 and FIG. 6, as the upper channel 530 drops vertically into the dispenser 500 down chute 550, and transitions into the lower feed channel 560, the side walls 510, 520 of the dispenser 500 recess inwardly to form a down chute 550 and lower feed channel 560 with widths "W2" and "W3", respectively, that are narrower than "W1".

FIG. 3 and FIG. 6 are front section views through the upper channel 530 and down chute 550, with a cartridge 220 inserted into the dispenser 500 showing nested cans 3, 4 issuing therefrom into the dispenser 500 down chute 550 through an upper channel exit port 555. FIG. 3 shows a two facing arrangement of cans 3, 4. FIG. 6 shows an arrangement of "N" can facings (N=4 in this particular example) and is shown at the level of the exit port 555 in the upper channel 530 through which the cans 3, 4 move from the cartridge 220 to the down chute 550.

Figure 7:
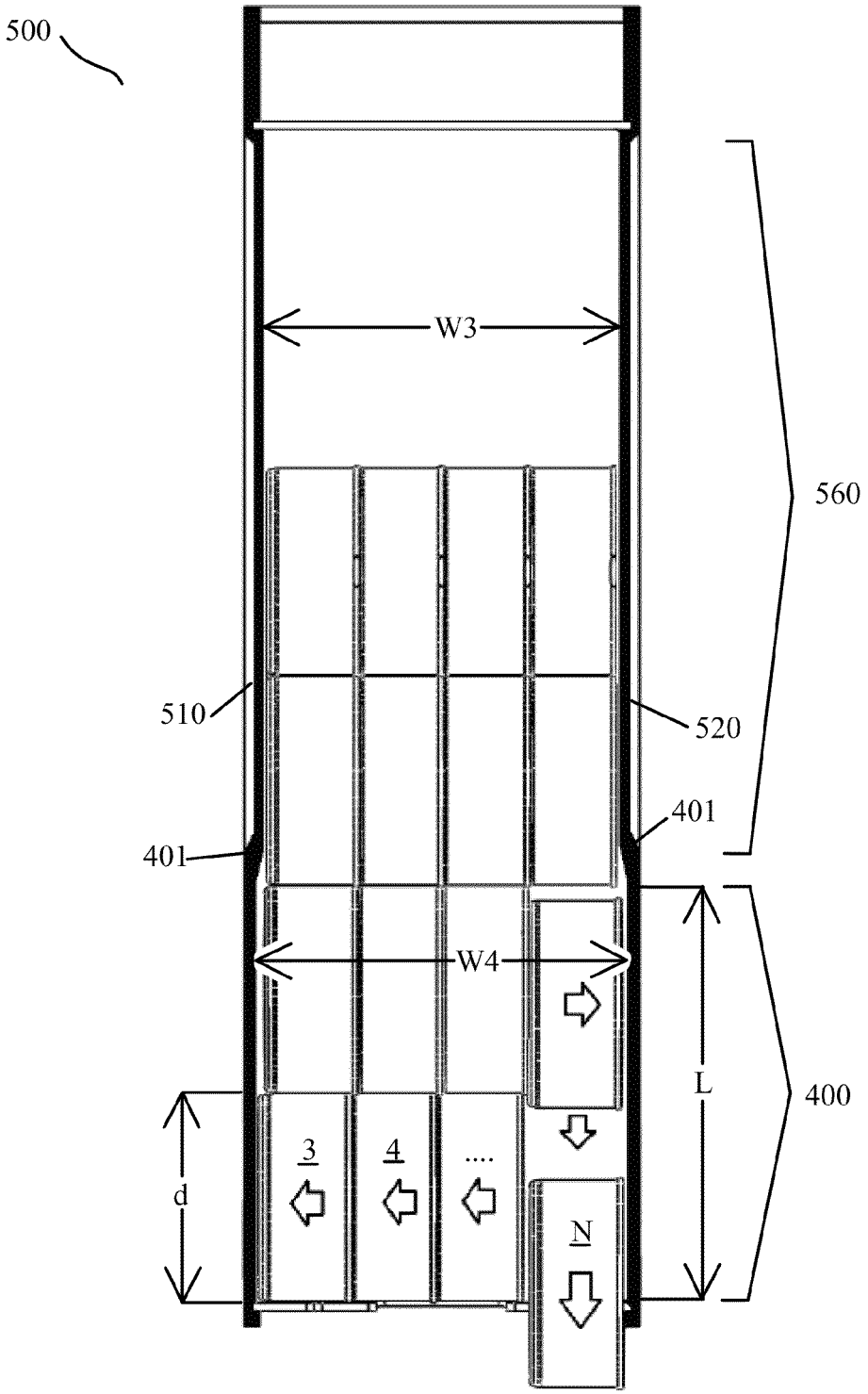
FIG. 7 shows a top view of the lower dispensing channel and product selection area of a dispenser with a variable width dispensing channel containing four facing nested cans.
Figure 8:
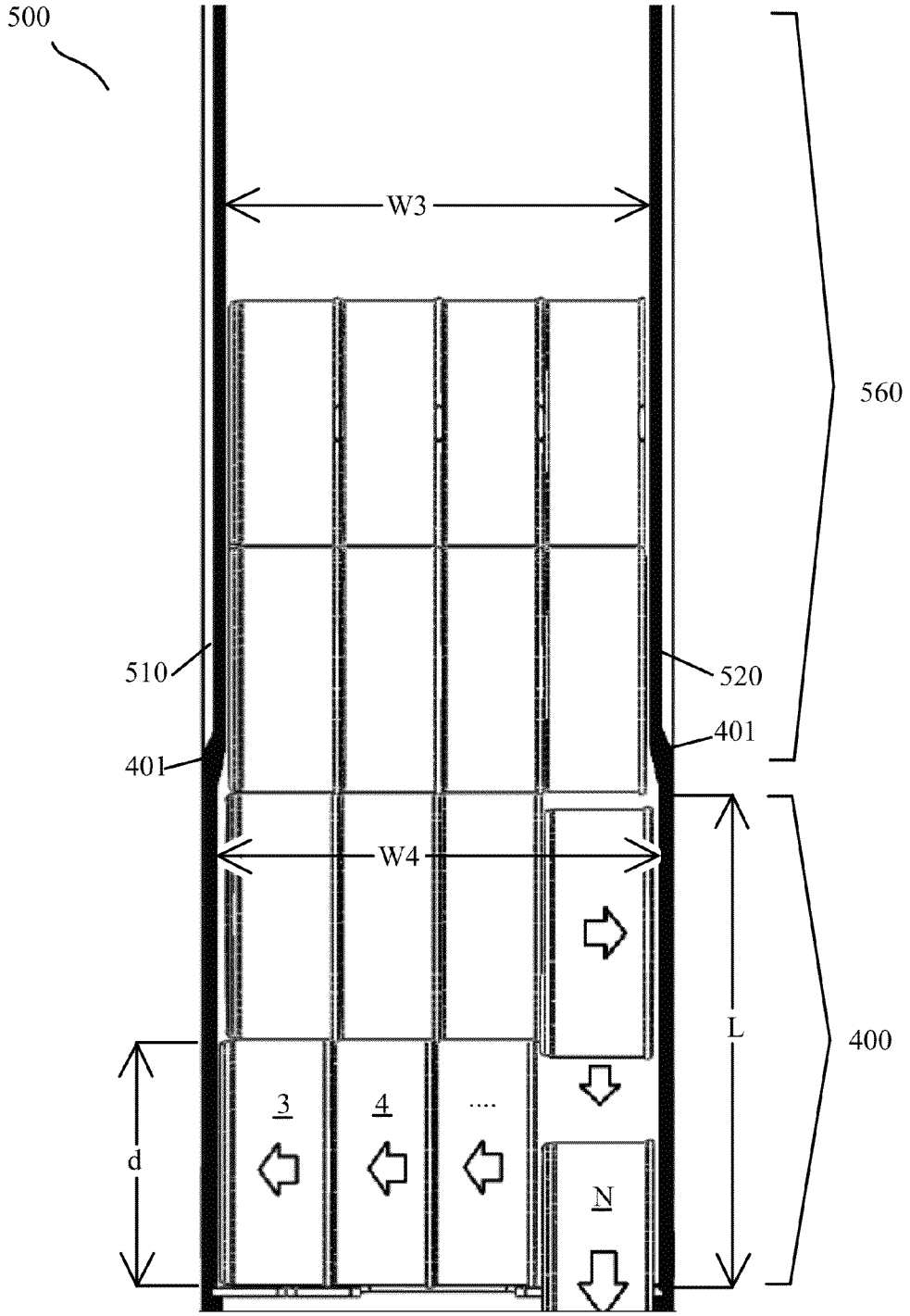
FIG. 8 shows a top view detail of the product selection area of a dispenser having a variable width dispensing channel.

FIG. 4 and FIG. 7 show the lower portion of the dispenser's 500 lower feed channel 560 and front-most dispensing area 400 for two different can 3, 4 facings. FIG. 8 shows a detail view of the lower, front area of the dispenser's lower feed channel 560 forming a product selection area 400 where individual products may be dispensed to shoppers one at a time.

Narrowing of the down chute 550 and lower feed channel 560 is accomplished by a variety of means including recessing portions of the housing sidewalls 510, 520, as shown in FIGS. 3-8. Alternatively, otherwise smooth, flat sidewalls can have glide ribbing added to the interior surfaces to create a narrowing effect, or other similar structural strictures can be formed in them or added as surface features. For each size and shape of can 3, 4 packaged and dispensed, the widths "W1" (upper channel 530), "W2" (down chute 550), "W3" (lower feed channel 560), and "W4" (product dispensing area 400) of the space between the dispenser 500 sidewalls 510, 520 are preferably of specific dimensions and tolerances matched to the can size and number of rows of cans being dispensed.

The widths "W2" of the down chute 550 and "W3" of the lower feed channel 560 are preferably sized to create a space both loose enough for the nested cans 3, 4, . . . , "N" to roll while remaining in their nested condition throughout the dispenser 500, but tight enough to prevent them from un-nesting during transit through the down chute 550 and lower feed channel 560. The width dimensions "W2" and "W3", and tolerances, are very important to the proper function of the dispenser 500. If the down chute 550 and lower feed channel 560 widths, "W2" and "W3" respectively, are too small, the cans 3, 4, . . . , "N" will not feed into and roll smoothly through the dispenser 500. If these widths are too large, the cans 3, 4, . . . , "N" can un-nest early, advance randomly, and jam in the lower feed channel 560 or down chute 550.

Preferably, widths "W2" and "W3" of the down chute 550 and lower feed channel 560, respectively, are in the range of "H"<"W2"<("H"+"Dn") and "H"<"W3"<("H"+"Dn"); where, as shown in FIG. 1B, "H" is the total height of the stack of nested cans, and "Dn" is the depth to which one can nests into one adjacent can.

Referring again to FIG. 3 and FIG. 6, it is further desirable to taper or chamfer 300 the transition between the wider ("W1"), upper channel 530 exit port and the narrower ("W2") down chute 550 such that the cans 3, 4, . . . , "N" are guided from the cartridge 220 into the down chute 550 without encountering any sharp edges or wall/rib end surfaces that might cause the cans 3, 4, . . . , "N" to hang up, bind, or otherwise jam. In one embodiment a chamfer angle, $\alpha$, in the range of 10 to 30 degrees relative to the plane of the dispenser side wall 510, 520 is preferably used.

Referring now to FIG. 4 and FIGS. 7-8, where the forward-most set of can 3, 4, . . . , "N" facings has rolled through the lower feed channel 560 and reached the dispensing location 400 at the lower front area of the dispenser 500, the side walls 510, 520 widen to the dispenser's 500 full width ("W4"). Widening of the space, from "W3" to "W4", between the sidewalls 510, 520 at the dispensing location 400 enables the front-most set, or sets, of cans 3, 4, . . . , "N" to un-nest for dispensing of individual cans 3, 4, . . . , "N" to shoppers. This transition 401 between the lower feed channel 560 and the dispensing location 400 is also preferably tapered or chamfered to enable a shopper to replace an unwanted can 3, 4, . . . , "N". In other words, preferably "W4">"H"+"Dn", where, as shown in FIG. 1B, "H" is the total height of the stack of nested cans, and "Dn" is the depth to which one can nests into one adjacent can.

Also as shown in FIG. 4 and FIGS. 7-8, the front to rear length, "L", of the widened ("W4") portion of the dispensing location 400 is preferably greater than the diameter, "d", of the cans 3, 4, . . . , "N" being dispensed to enable un-nesting of the entire front-most set of cans 3, 4, . . . , "N", yet should preferably be less than three times the diameter, "d". If the length, "L", of the widened ("W4") dispensing location 400 is greater than two times the can 3, 4, . . . , "N" diameter, "d", the second row of cans may un-nest as well, as shown in detail in FIG. 8, behind the front-most set of cans 3, 4, . . . , "N". A greater length "L" enables the second row of cans 3, 4, . . . , "N" to un-nest and roll forward individually as the front-most cans 3, 4, . . . , "N" are singly dispensed to shoppers. As a result the front-most row of cans 3, 4, . . . , "N" will always be full, or auto-front faced as known in the industry. Auto-front facing is preferable as it prevents the appearance of a low stock condition.

In other words, as shown in FIG. 4 and FIGS. 7-8, the preferred range of lengths, "L", for the widened ("W4") dispensing location 400 is expressed as; $d<L<3d$; where "L" is the length of the widened dispensing location 400, and "d" is the diameter of a can 3, 4, . . . , "N" being dispensed. If "L" is too short, the front-most row of cans will not properly un-nest for the shopper. If "L" is too long, the rows of cans behind the first two can rows will un-nest too early and potentially jam as they roll through the lower feed channel 560.

As was the case at the transition 300 between the upper channel 530 exit port and the narrower down chute 550, it is also desirable to taper or chamfer 300 the transition between the narrower ("W3"), lower feed channel 560 and the wider ("W4") product selection area 400 such that the cans 3, 4, . . . , "N" are smoothly guided from the lower feed channel 560 to the wider ("W4") product selection area 400 without encountering any sharp edges or wall/rib end surfaces that might cause the cans 3, 4, . . . , "N" to hang up, bind, or otherwise jam when a shopper chooses to return a can to the dispenser, causing cans to move back toward the lower feed channel 560. In one embodiment a chamfer angle, $\alpha$, in the range of 10 to 30 degrees relative to the plane of the dispenser side wall 510, 520 is preferably used.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An improved serpentine product dispenser of the type having a top, bottom, front, and rear for dispensing cans from a cartridge containing a plurality of stacks of nested cans; each can having a diameter; each stack of nested cans forming at least two product facings; and the cartridge having an exit port; an upper channel with a first width allowing a cartridge containing a plurality of can stacks to be inserted, located at the top of the dispenser, forming a cartridge holding area for receiving and holding the cartridge; an upper channel exit port, located at a bottom of the upper channel and to the rear of the dispenser, through which stacks of nested cans pass when exiting the exit port of a cartridge received and held on the upper channel; a down chute located at the rear of the dispenser below the upper channel exit port, with a first end, a second end, and a second width, the first end of the down chute communicating in a transition with the upper channel exit port such that a stack of nested cans may move from the upper channel into the down chute; a lower feed channel located at the bottom of the dispenser with a first end, a second end, and a third width, the first end of the lower feed channel communicating in a transition with the second end of the down chute, such that a stack of nested cans may move from the down chute through the lower feed channel; and a product selection area at the bottom and front of the dispenser having a first end, a second end accessible to a consumer, a length, and a fourth width, the first end of the product selection area communicating in a transition with the second end of the lower feed channel such that a stack of nested cans may move from the lower feed channel into the product selection area; the improvement comprising:

a) the second width of the down chute being narrower than the upper channel first width, such that a stack of nested cans exiting the upper channel through the upper channel exit port are maintained in a nested stack when moving from the upper channel into and through the down chute;

b) the third width of the lower feed channel being narrower than the upper channel first width, such that a stack of nested cans is maintained in a nested stack as the stack of nested cans transits through the lower feed channel; and c) the fourth width of the product selection area being wider than the lower feed channel third width, such that the forth width allows the stack of nested cans to be un-nested and separated for individual selection by a consumer.

2. The serpentine product dispenser of claim 1, wherein the product selection area length is at least one can diameter and not greater than two can diameters, such that a front most stack of nested cans forming two or more product facings in the product selection area is separable and cans are individually selectable by a consumer.

3. The serpentine product dispenser of claim 1, wherein the product selection area length is at least two can diameters and not greater than three can diameters; such that two stacks of nested cans present in the product selection area form a first set of product facings that is separable in the product selection area and a second set of product facings that is separable in the product selection area; the product selection area being auto-front facing when one or more cans are removed from the first set of product facings allowing one or more cans from the second set of product facings to roll forward in the product dispensing area and replace the cans removed from the dispensing area.

4. The serpentine product dispenser of claim 1, wherein a transition between the upper channel first width and down chute second width at the down chute first end is a chamfer.

5. The serpentine product dispenser of claim 4, wherein the chamfer forms an angle in the range of 10 to 30 degrees relative to a plane of a dispenser side wall.

6. The serpentine product dispenser of claim 1, wherein a transition between the lower channel third width at the lower channel second end and the product selection area fourth width at the product selection area first end is a chamfer.

7. The serpentine product dispenser of claim 6, wherein the chamfer forms an angle in the range of 10 to 30 degrees relative to a plane of a dispenser side wall.

8. A serpentine product dispenser with a top, bottom, front, and rear for dispensing cans from a cartridge containing a plurality of stacks of nested cans; each can having a diameter; each stack of nested cans forming at least two product facings; and the cartridge having an exit port, comprising:

a) an upper channel with a first width allowing a cartridge containing a plurality of can stacks to be inserted, located at the top of the dispenser, forming a cartridge holding area for receiving and holding the cartridge;

b) an upper channel exit port, located at a bottom of the upper channel and to the rear of the dispenser, through which stacks of nested cans pass when exiting the exit port of a cartridge received and held on the upper channel;

c) a down chute located at the rear of the dispenser below the upper channel exit port, with a first end, a second end, and a second width narrower than the upper channel first width, such that a stack of nested cans exiting the upper channel through the upper channel exit port are maintained in a nested stack when moving from the upper channel into and through the down chute; the first end of the down chute communicating in a transition with the upper channel exit port, the transition between the upper channel first width and down chute second width at the down chute first end being a chamfer, such that a stack of nested cans may move from the down chute through the lower feed channel; and d) a lower feed channel located at the bottom of the dispenser with a first end, a second end, and a third width narrower than the upper channel first width, such that a stack of nested cans is maintained in a nested stack as the stack of nested cans transits through the lower feed channel; the first end of the lower feed channel communicating in a transition with the second end of the down chute, such that a stack of nested cans may move from the down chute through the lower feed channel; and e) a product selection area at the bottom and front of the dispenser having a first end, a second end accessible to a consumer, a fourth width wider than the lower feed channel third width, and a length; the first end of the product selection area communicating in a transition with the second end of the lower feed channel such that a stack of nested cans may move from the lower feed channel into the product selection area, where the forth width allows the stack of nested cans to be un-nested and separated for individual selection by a consumer.

9. The serpentine product dispenser of claim 8, wherein the chamfer forms an angle in the range of 10 to 30 degrees relative to a plane of a dispenser side wall.

10. The serpentine product dispenser of claim 8, wherein a transition between the lower channel third width at the lower channel second end and the product selection area fourth width at the product selection area first end, is a chamfer.

11. The serpentine product dispenser of claim 10, wherein the chamfer forms an angle in the range of 10 to 30 degrees relative to a plane of a dispenser side wall.

12. The serpentine product dispenser of claim 8, wherein the product selection area length is at least one can diameter and not greater than two can diameters, such that a front most stack of nested cans forming two or more product facings in the product selection area is separable and cans are individually selectable by a consumer.

13. The serpentine product dispenser of claim 8, wherein the product selection area length is at least two can diameters and not greater than three can diameters; such that two stacks of nested cans present in the product selection area form a first set of product facings that is separable in the product selection area and a second set of product facings that is separable in the product selection area; the product selection area being auto-front facing when one or more cans are removed from the first set of product facings allowing one or more cans from the second set of product facings to roll forward in the product dispensing area and replace the cans removed from the dispensing area.

14. A serpentine product dispenser with a top, bottom, front, and rear for dispensing cans from a cartridge containing a plurality of stacks of nested cans; each can having a diameter; each stack of nested cans forming at least two product facings; and the cartridge having an exit port, comprising:

a) an upper channel with a first width allowing a cartridge containing a plurality of can stacks to be inserted, located at the top of the dispenser, forming a cartridge holding area for receiving and holding the cartridge;

b) an upper channel exit port, located at a bottom of the upper channel and to the rear of the dispenser, through which stacks of nested cans pass when exiting the exit port of a cartridge received and held on the upper channel;

c) a down chute located at the rear of the dispenser below the upper channel exit port, with a first end, a second end, and a second width narrower than the upper channel first width, such that a stack of nested cans exiting the upper channel through the upper channel exit port are maintained in a nested stack when moving from the upper channel into and through the down chute; the first end of the down chute communicating in a transition with the upper channel exit port such that a stack of nested cans may move from the upper channel into the down chute;

d) a lower feed channel located at the bottom of the dispenser with a first end, a second end, and a third width narrower than the upper channel first width, such that a stack of nested cans is maintained in a nested stack as the stack of nested cans transits through the lower feed channel; the first end of the lower feed channel communicating in a transition with the second end of the down chute, the transition between the lower channel third width at the lower channel second end and the product selection area fourth width at the product selection area first end, being a chamfer, such that a stack of nested cans may move from the down chute through the lower feed channel; and e) a product selection area at the bottom and front of the dispenser having a first end, a second end accessible to a consumer, a fourth width wider than the lower feed channel third width, and a length; the first end of the product selection area communicating in a transition with the second end of the lower feed channel such that a stack of nested cans may move from the lower feed channel into the product selection area, where the forth width allows the stack of nested cans to be un-nested and separated for individual selection by a consumer.

15. The serpentine product dispenser of claim 14, wherein the chamfer forms an angle in the range of 10 to 30 degrees relative to a plane of a dispenser side wall.

16. The serpentine product dispenser of claim 14, wherein the product selection area length is at least one can diameter and not greater than two can diameters, such that a front most stack of nested cans forming two or more product facings in the product selection area is separable and cans are individually selectable by a consumer.

17. The serpentine product dispenser of claim 14, wherein the product selection area length is at least two can diameters and not greater than three can diameters; such that two stacks of nested cans present in the product selection area form a first set of product facings that is separable in the product selection area and a second set of product facings that is separable in the product selection area; the product selection area being auto-front facing when one or more cans are removed from the first set of product facings allowing one or more cans from the second set of product facings to roll forward in the product dispensing area and replace the cans removed from the dispensing area.

* * * * *

UNITED STATES PATENT AND TRADEMARK OFFICE

CERTIFICATE OF CORRECTION

PATENT NO. : 8,955,695 B2
APPLICATION NO. : 14/208632
DATED : February 17, 2015
INVENTOR(S) : Jamie D. Bauer It is certified that error appears in the above-identified patent and that said Letters Patent is hereby corrected as shown below:

In the Claims

Claim 1 (Column 6, line 32): replace “forth,” with “fourth”

Claim 8 (Column 7, line 42): replace “forth,” with “fourth”

Claim 14 (Column 8, line 50): replace “forth,” with “fourth”

Signed and Sealed this
Ninth Day of June, 2015

Michelle K. Lee

Michelle K. Lee
*Director of the United States Patent and Trademark Office*